US006299330B1

(12) United States Patent
Michl et al.

(10) Patent No.: US 6,299,330 B1
(45) Date of Patent: Oct. 9, 2001

(54) CONCERTINA LAMP

(76) Inventors: Oliver Michl; Patrick Frieling, both of Zionskirchstrasse 25, D-10119 Berlin (DE)

( * ) Notice: Subject to any disclaimer, the term of this patent is extended or adjusted under 35 U.S.C. 154(b) by 0 days.

(21) Appl. No.: 09/384,629

(22) Filed: Aug. 27, 1999

(30) Foreign Application Priority Data

Aug. 28, 1998 (DE) ..... 198 39 284

(51) Int. Cl.[7] ..... F21V 21/22

(52) U.S. Cl. ..... 362/239; 362/250; 362/281; 362/352

(58) Field of Search ..... 362/232, 238, 362/239, 250, 278, 281, 285, 418, 450, 352, 360, 320, 429, 427

(56) References Cited

U.S. PATENT DOCUMENTS 18,154 * 9/1857 Monson ..... 362/285
685,247 * 10/1901 Boltman ..... 362/285
2,683,801 * 7/1954 Faselt ..... 362/352
3,619,599 * 11/1971 Hermanson ..... 362/250
5,709,461 1/1998 Michl et al. .
5,791,775 * 8/1998 Douglass, II. ..... 362/283

* cited by examiner

*Primary Examiner*—Y. Quach
(74) *Attorney, Agent, or Firm*—Alston & Bird LLP

(57) ABSTRACT

For a concertina lamp (1) with a minimum of one concertina arm (2) and a minimum of two lamps (6, 12) attached to concertina arm rods (5) lying behind each other, a lampshade (4) is provided for each lamp (6, 12), which is attached to the same concertina arm rod (5) as the respective lamp (6, 12) and all lampshades (4) are telescopically designed so that they overlap each other at least partially while the concertina arm (2) is retracted.

13 Claims, 4 Drawing Sheets

CONCERTINA LAMP

BACKGROUND OF THE INVENTION

The invention relates to a concertina lamp with a minimum of one concertina arm and a minimum of two lamps attached to concertina arm rods lying behind each other.

Concertina lamps are known which are designed as horizontally extendable pendant lamps. Wherein a lighting device or lamp is attached to each of several links or rods of a horizontal concertina arm, which is connected to a power supply by a cable. While the concertina arm is retracted they form a compact lamp system, and an oblong bank of lamps, while it is extended.

An electrical concertina lamp has become known through DE 195 11 839 C2 and corresponding U.S. Pat. No. 5,709,461, where two identical concertina arms parallel to each other made of electrically conductive material, whose hinge points are opposite each other, are equipped with sockets for festoon bulbs on at least two opposite hinge points and are connected with each other by a festoon bulb. Each concertina arm is connected to its respective terminal of a low-voltage power supply.

These concertina lamps allow extensive variation to the desired illumination area, but they cause an increased dazzling due to the bare lighting devices or lamps. Apart from that it may be desired for aesthetic reasons to cover the concertina arms.

Therefore, the aim of the present invention is to improve a concertina lamp of this type so that the dazzling will be reduced and an extensive covering of the concertina arms will be possible.

SUMMARY OF THE INVENTION

According to the invention this task is solved with a concertina lamp of the above mentioned type by providing a lampshade for each lamp, which is attached to the same concertina arm rod as the respective lamp, and by designing all lampshades as telescopic, so that they will at least partially overlap each other while the concertina arm is retracted.

The measures according to the invention also allow the screening of concertina lamps, progressively lengthwise adjustable lighting systems, with lamps lying behind each other, so that their dazzling will be extensively reduced. By attaching a lampshade to the same concertina arm rod as the lamp and by designing the lampshades so that they fit into each other or are telescopic, the lampshades are able to follow each movement of the concertina arm or the concertina arms progressively without obstructing the extension or retraction of the concertina arm through binding. The lampshades can additionally be designed so that they not only screen the respective lamp but also cover the whole concertina arm rod to which the respective lamp is attached.

In the preferred design of the invention the lampshades extend in the same direction as the concertina arm. But they can also extend in the direction in which the concertina arm retracts. It is important that the extensions of the lampshades are in the direction of the movement of the concertina arm in order to enable the telescoping of the lampshades and their partial overlapping while the concertina arm is retracted.

The lampshades are preferably U-shaped and cover all concertina arms wherein the arms of the "U" are attached to the outside of the external concertina arms. This permits the attachment of the lampshades to the concertina arm with minimal technical effort while screening the individual lamp and simultaneously concealing the applicable concertina arm rod.

Alternatively, the lampshades can completely surround all concertina arms perpendicular to the direction of movement and are attached to the outside of the external concertina arms. In this way complete screening of the lamps as well as the complete concealment of the applicable section of the concertina arm is achieved.

Further improvements to the invention include the lampshades being constructed in a plastic foil which is flexible, has inherent stability sufficient to achieve form stability while the plastic foil is bent and has openings designed to slide onto buttons on the concertina arm(s), and lock into place. This allows economical production of lampshades for a concertina lamp. For example, it is possible to design the lampshades as stamped parts. In order to use the lampshades the stamped parts need only to be equipped with openings designed to lock onto buttons on the concertina arm(s). Due to their flexibility the stamped parts can then be easily bent into a lampshade and locked onto the above mentioned buttons.

According to an advantageous design of the invention one section of a concertina arm rod, that is positioned between two adjacent hinge points of a concertina arm rod can be replaced by a sufficiently rigid section of a lampshade which is attached to these two hinge points on the concertina arm. Due to these measures it is possible to save material from the concertina arm(s) and to reduce the production time. Furthermore a section of the concertina arm rod or even a whole concertina arm rod can be formed as part of a lampshade in an aesthetically more pleasing way.

BRIEF DESCRIPTION OF THE DRAWINGS

The invention will be described in more detail using the examples in the drawing as follows.

DETAILED DESCRIPTION OF THE PREFERRED EMBODIMENT

Figure 1:
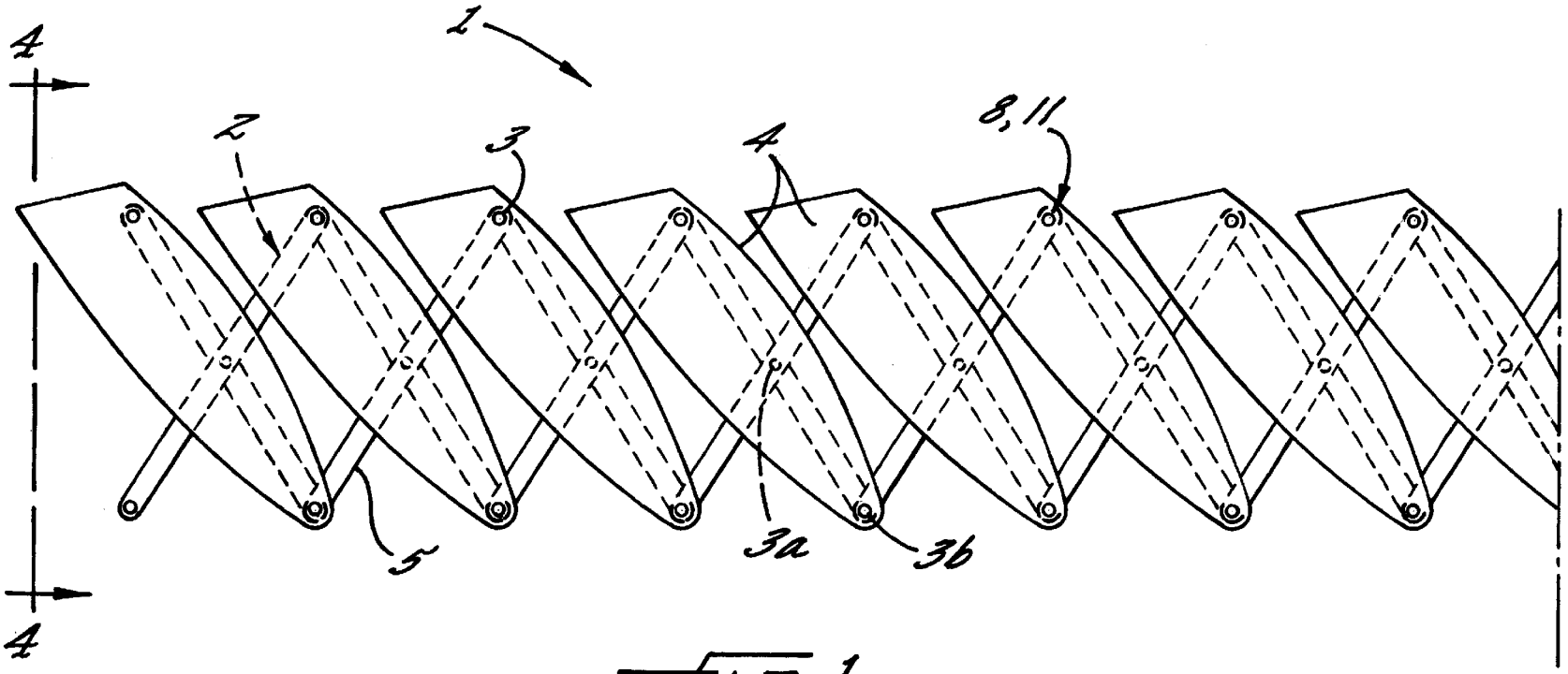
FIG. 1 A partial side view of a concertina lamp according to the invention, which has its fixed point on one of its ends.

The examples of concertina lamps 1 according to the invention illustrated in the figures consist of one concertina arm 2, or two parallel concertina arms 2*a*, 2*b*, whose hinge points 3 are opposite each other, and lampshades 4 which are attached to hinge points 3 of concertina arm rod 5.

Even though the illustrated concertina lamps 1 are horizontally orientated, the position of the concertina lamp according to the invention in reality is variable. It can be horizontally or vertically positioned or, for that matter, at any angle.

In the example according to FIG. 1 the concertina lamp 1 is fastened stationary at one of its ends. The concertina arms 2 will only extend and retract in one direction at a time. All lampshades 4 are orientated in one direction and they are positioned behind each other while the concertina arm 2 or the concertina arms 2*a*, 2*b* are extended.

Figure 2:
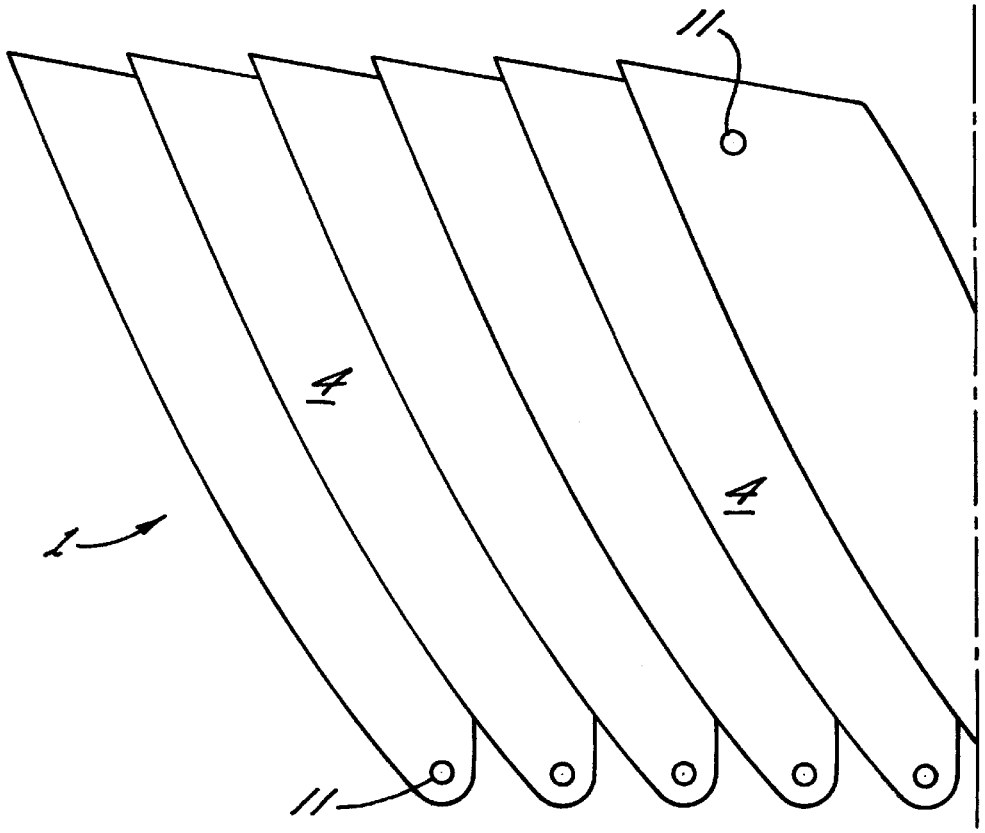
FIG. 2 A view similar to FIG. 1 with the concertina lamp in the retracted state.

FIG. 2 displays this concertina lamp 1 in a retracted state wherein the concertina arm rods are omitted for clarity. The lampshades 4 are telescoping and partially overlapping each other.

Figure 3:
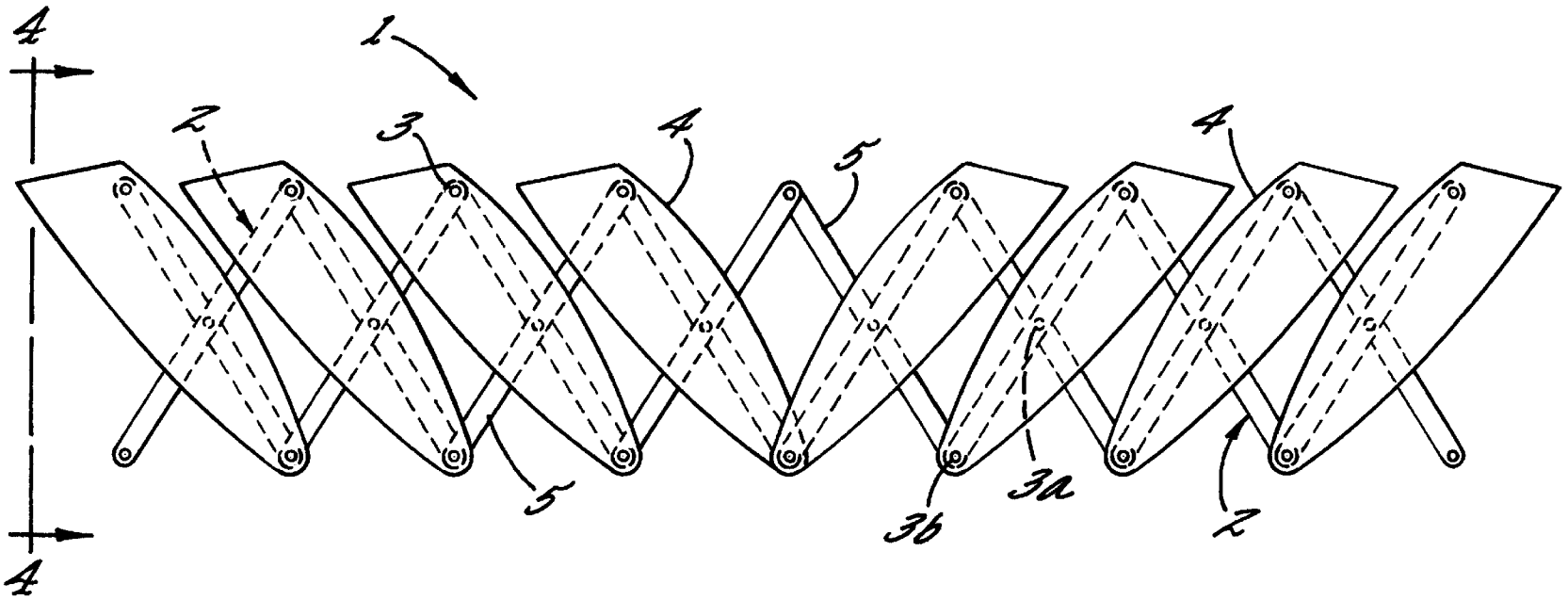
FIG. 3 A side view of a concertina lamp according to the invention, which has its fixed point in the center.

In the example of a concertina lamp 1 according to the invention illustrated in FIG. 3 its fixed point is located at the center. The extension and retraction of the concertina lamp halves is carried out from the center in opposite directions. The lampshades 4 of the two lamp halves are accordingly orientated in opposite directions.

Figure 4B:
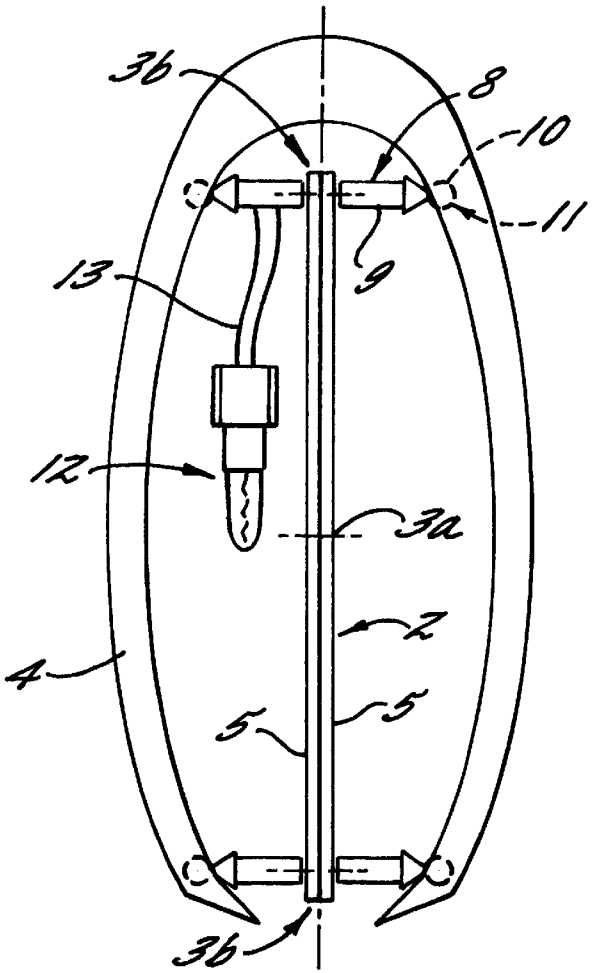
FIGS. 4*a* and 4*b*—The views of two cross-sections through the lines "IV—IV" in FIGS. 1 and 3.
Figure 4A:
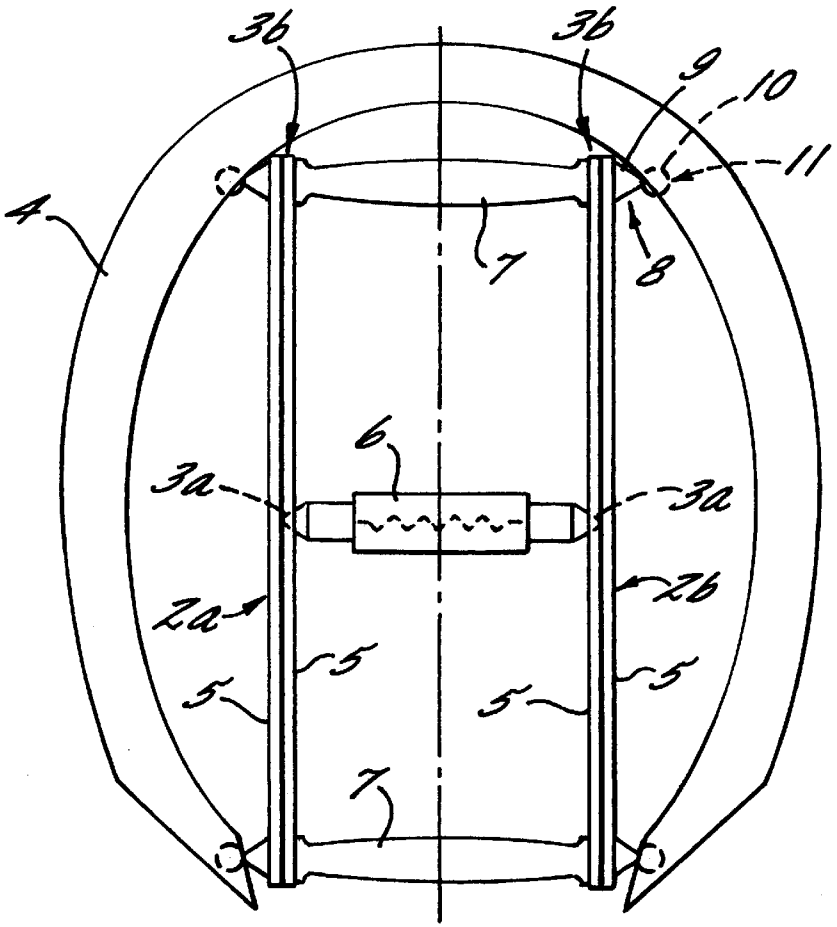

The concertina arms 2 consist of single flat uniform rods 5 that are joined with a hinge to their adjacent rods 5 at their center 3*a* and their ends 3*b* (FIGS. 4*a* and 4*b*). In the example according to FIG. 4*a* the concertina arm rods 5 of the two parallel concertina arms 2*a*, 2*b* are made of electrically conductive material. The concertina arms 2*a*, 2*b* are each connected to the respective terminal of a low-voltage power supply, for example 12 V, and supply festoon bulbs 6, which are attached in appropriate sockets between opposite hinge points 3 of the two parallel concertina arms 2*a*, 2*b*.

As shown in FIG. 4*a*, the two external series of hinges 3*b* of the parallel concertina arms 2*a*, 2*b* are connected with each other through spacers 7 while the festoon bulbs 6 are connected between the series of hinges 3*a* in the center. Fasteners 8 for a lampshade 4 project from the external series of hinges 3*b* to the outside, which means towards the side away from the concertina lamp 1. The four fasteners 8 each consist of one holding section 9, which is fastened on the respective hinge point 3, and a spherical head or button 10, which is designed to be inserted in an opening 11 provided in the lampshade 4. This spherical button 10 and the associated opening 11 in the lampshade 4 form a ball and socket type locking device which holds the lampshade 4 perpendicular to the direction of the concertina arm's movement and allows it to rotate on the level of the concertina arm 2. Due to this easy locking or clamping of the individual lampshades 4 on the concertina arms 2 it is possible to fasten the lampshades 4 quickly and with little effort, as well as to change these quickly and easily if necessary.

In FIG. 4*b* a concertina lamp 1 according to the invention is shown as an example with only one concertina arm 2, where the lighting devices or lamps 12 are supplied with power through a cable 13, for example 220 V. Each lampshade 4 is also connected with the concertina arm 2 through four locking points 8. The number of the concertina arms 2 is variable. One, two, three or more parallel concertina arms could be provided.

The concertina arms 2 must not necessarily be made of electrically conductive material. If cable lamps 12 are provided, for example, it is possible to use a plastic concertina arm construction.

The illustrated lampshades 4 are all identically designed and extend like a truncated cone in the extension direction of the concertina lamp 1. They cover the concertina arms 2 from the top in the shape of a "U" or a horseshoe. Their inherent stability is designed so that further accessories are not necessary in order to maintain their shape.

Any material can be used for the lampshades 4, for example plastic, wood, paper, metal. The surfaces of the lampshades 4 can be imprinted with any color or design such as fur or laminated with foil or similar material. Coated surfaces such as metal coating or similar are also possible. Geometrical figures, abstract silhouettes or even graphical animal forms in symmetrical or asymmetrical design are possible shapes for the lampshades 4.

Due to the fact that the lampshades 4 cover the construction of the concertina arm at least partially, the material and surfaces of the concertina arms 2 can be kept simple and the technical effort can be reduced accordingly. In the case of concertina lamps 1 with cable lamps 12 it is also possible to cover the cable 13 with the lampshades 4.

What is claimed is:

1. A concertina-type electrical lamp comprising at least one concertina arm which comprises a plurality of rods which are joined to each other in a crossing relationship at a plurality of pivotal joints so as to permit extension and retraction of the length of the arm in a longitudinal direction, an electrical lamp attached to each of at least a plurality of said rods, and a lampshade attached to each rod which attaches an electrical lamp, with said lampshades being telescopically designed so that they at least partially overlap each other when the length of the concertina arm is retracted.

2. The concertina-type electrical lamp as defined in claim 1 wherein each of said lampshades is of U-shaped configuration and substantially surrounds said at least one concertina arm in a direction substantially perpendicular to the longitudinal direction.

3. The concertina-type electrical lamp as defined in claim 2 wherein each lampshade is attached to its associated rod by means of a ball and socket type interconnection at each of at least two pivotal joints on the rod.

4. The concertina-type electrical lamp as defined in claim 3 wherein each ball and socket interconnection comprises a socket in the associated lampshade and a ball attached to the associated rod.

5. The concertina-type electrical lamp as defined in claim 1 wherein said concertina-type electrical lamp comprises a single concertina arm.

6. The concertina-type electrical lamp as defined in claim 1 wherein said concertina-type electrical lamp comprises two identical concertina arms which extend parallel to each other, with the pivotal joints of the rods of the two arms being respectively aligned to define a plurality of pairs of opposed joints, and with at least a plurality of said opposed joints being interconnected by one of said electrical lamps.

7. The concertina-type electrical lamp as defined in claim 6 wherein some of said pairs of opposed joints are not each interconnected by an electrical lamp and are each interconnected by a spacer.

8. The concertina-type electrical lamp as defined in claim 7 wherein each of said lampshades is of U-shaped configuration and substantially surrounds both of said two identical concertina arms in a direction substantially perpendicular to the longitudinal direction.

9. The concertina-type electrical lamp as defined in claim 8 wherein each of said lampshades is attached to aligned rods of the two concertina arms by means of at least one ball and socket interconnection.

10. The concertina-type electrical lamp as defined in claim 1 wherein each lampshade completely surrounds the one concertina arm so as to lie generally perpendicular to the longitudinal direction.

11. The concertina-type electrical lamp as defined in claim 1 wherein each lampshade is made of flexible plastic foil having sufficient stability to achieve form stability when the plastic foil is bent.

12. The concertina-type electrical lamp as defined in claim 1 wherein at least one of the rods of said one concertina arm comprises a sufficiently rigid section of one of the lampshades.

13. A concertina-type electrical lamp comprising at least one concertina arm comprising a plurality of longitudinally aligned X-shaped segments which are each composed of a pair of crossing rods, with the pair of crossing rods of each X-shaped segment having opposite ends which are pivotally joined to respective ends of the crossing rods of the adjacent X-shaped segments, so as to permit extension and retraction of the longitudinal length of the arm, an electrical lamp attached to each of at least a plurality of said X-shaped segments, and a plurality of lampshades attached to each of said X-shaped segments which attaches an electrical lamp so as to essentially overlie the lamp, with said lampshades being sized and configured so as to at least partially overlap each other when the length of the arm is retracted and be essentially separated from each other in the longitudinal direction when the length of the arm is extended.

* * * * *

UNITED STATES PATENT AND TRADEMARK OFFICE

CERTIFICATE OF CORRECTION

PATENT NO. : 6,299,330 B1
DATED : October 9, 2001
INVENTOR(S) : Michl et al.

It is certified that error appears in the above-identified patent and that said Letters Patent is hereby corrected as shown below:

Title page,
Item [56], References Cited, U.S. PATENT DOCUMENTS,
"Boltman" should read -- Bowman --.

Column 4,
Line 10, "rod which attaches an" should read -- of at least a plurality of rods which attach the --;
Line 17-18, "one concertina arm" should read -- a plurality of said rods --;
Line 44, after "surrounds" insert -- a plurality of rods of --;
Line 52, after "surrounds" insert -- the plurality of rods of --.

Signed and Sealed this

Twenty-fifth Day of June, 2002

*Attest:*

*Attesting Officer*

JAMES E. ROGAN
*Director of the United States Patent and Trademark Office*